United States Patent [19]

Ebner

[11] Patent Number: 4,540,364

[45] Date of Patent: Sep. 10, 1985

[54] PUSHER-TYPE FURNACE

[76] Inventor: Peter Ebner, Bergham 168, A-4060 Leonding, Austria

[21] Appl. No.: 535,156

[22] Filed: Sep. 23, 1983

[30] Foreign Application Priority Data

Oct. 1, 1982 [AT] Austria ..... 3635/82

[51] Int. Cl.[3] ..... F27D 3/00

[52] U.S. Cl. ..... 432/234; 432/153; 198/721

[58] Field of Search ..... 432/233, 234, 127, 153, 432/162; 198/721; 414/150, 157; 193/38, 41

[56] References Cited

U.S. PATENT DOCUMENTS 1,647,665 11/1927 Riche ..... 193/38
4,125,365 11/1978 Nelson ..... 432/153
4,412,816 11/1983 Schlumberger et al. ..... 198/721

FOREIGN PATENT DOCUMENTS 597928 6/1934 Fed. Rep. of Germany .
2039507 2/1972 Fed. Rep. of Germany .
2302490 9/1976 France ..... 432/234
931261 7/1963 United Kingdom ..... 432/234

*Primary Examiner*—Henry C. Yuen
*Assistant Examiner*—John Kwon
*Attorney, Agent, or Firm*—Kurt Kelman

[57] ABSTRACT

The material to be processed through a furnace is carried on skid rails by sliding shoes. In order to reduce the friction between the skid rails and the sliding shoes, and the breakaway forces at the start of the pushing motion, slip plates are fitted in shallow recesses in the top of the skid rails.

2 Claims, 5 Drawing Figures

FIG. 2
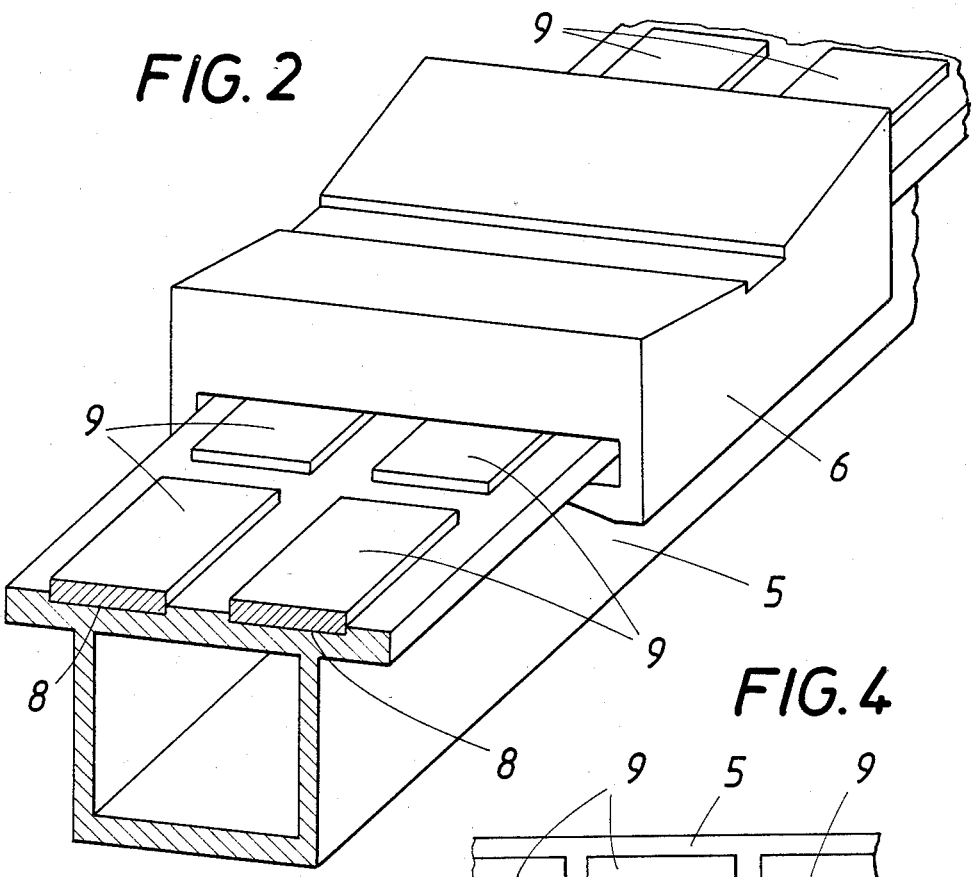
FIG. 4
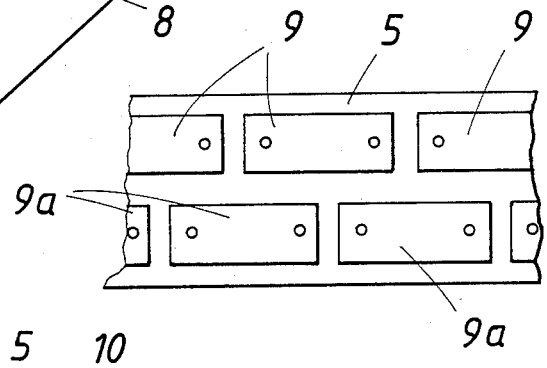
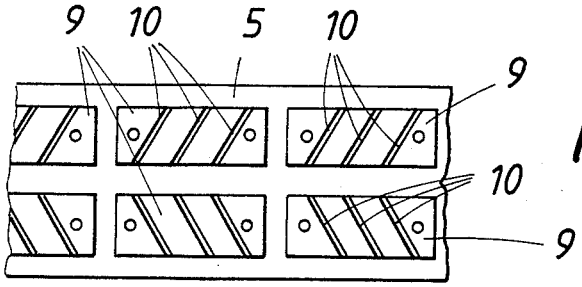
FIG. 5

PUSHER-TYPE FURNACE

This invention relates to a pusher-type furnace which comprises skid rails for sliding shoes carrying the material to be processed through the furnace and elements that reduce the friction between the skid rails and the sliding shoes.

As a rule, this type of pusher-type furnace is used to heat-treat aluminium or aluminium alloy slabs; normally, a hydraulic pusher mechanism pushes the slabs, which may weigh several tons, through the furnace. To reduce the breakaway forces occurring at the beginning of the pushing motion, ensure that the heavily loaded sliding shoes move along the rails without jolts, and reduce wear, it has been proposed to equip the underside of the shoes (which have a basically U-shaped cross-section) with at least one slip element, which preferably takes the form of a strip parallel to the direction of transport, consisting of an alloy self-lubricated with colloidal graphite. However, there are various disadvantages in attaching these elements to the sliding shoes.

Since the shoes are loaded outside the furnace, then pass through the furnace, and finally leave it again, they are subjected to continually changing thermal cycling, which involves a considerable strain on the slip elements. At the joint between rail sections, differences in height may cause the end of a slip element to disintegrate. There is also a risk of the slip element breaking, e.g. when a slab weighing several tons is placed on the sliding shoes. The detritus resulting from the slip elements disintegrating, and the material particles normally worn off, both necessarly stay on the rails and naturally impair the performance of the slip elements on the sliding shoes. Finally, there is a danger that fasteners such as bolts may loosen sufficiently for the slip elements on the sliding shoes to block the shoe movement inside or outside the furnace, which may lead to the slabs, which are stood up on end, falling over and seriously damaging the entire furnace.

It is an object of the invention to avoid these disadvantages and so to improve a pusher-type furnace of the kind described hereinbefore that the friction between the skid rails and the sliding shoes and the breakaway forces at the start of the pushing motion can be reduced, without any need to accept a risk of damage to the slip elements, a deterioration in their slip properties or other damage.

This object is accomplished according to the invention with a series of aligned slip plates fitted in shallow recesses in, and spaced along, the top of the skid rails.

The slip elements are thus no longer fastened to the underside of the sliding shoe mid-section, but are located on top of the rails. They always stay in the same place, i.e. at an unchanging working temperature, and are not subjected to thermal cycling. Enough space is left between the aligned slip plates to accommodate detritus and particles worn off, so that the slip properties are not impaired, since the sliding shoes run on the surface of the slip plates (which is free from foreign matter), while the detritus etc. can accumulate in the space below the plate surface. Damage to the slip plates around the joint between the rail sections is of course ruled out, since the plates are fitted in the rails themselves and do not move over them. Should the bolts or other fasteners loosen, this has no effect on the process of pushing the sliding shoes through the furnace, since the frictional forces developed at the slip plates when the sliding shoes move are transferred via the end wall of the recess to the rail itself, i.e. no load is applied to the fasteners. Even slip plates which have disintegrated do their job without difficulty in the recesses provided for them.

According to a preferred feature of the invention, the slip plates, which are located in two rows parallel to the furnace access, have superficial grooves at an angle to this access, the grooves in the plates in one row being arranged as a mirror image of the grooves in the plates in the other row. Detritus etc. from the shoes sliding over the slip plates passes via these superficial grooves to the space outside the plate in question; the mirror-image arrangement of the grooves cancels out any frictional forces operating at an angle to the furnace access.

According to a further feature, each joint between rail sections is covered over by slip plates, evening out slight variations in height between the sections at these joints.

The subject matter of the invention is shown by way of example in the drawings, in which FIG. 1 is a diagrammatic sectional view showing a pusher-type furnace according to the invention;

FIG. 2 is an axonometric perspective view showing a skid rail with sliding shoe in place;

FIG. 4 is a top plan view showing a rail with slip plates arranged in various patterns; and FIG. 5 is a top plan view showing a rail with grooved slip plates.

Figure 1:
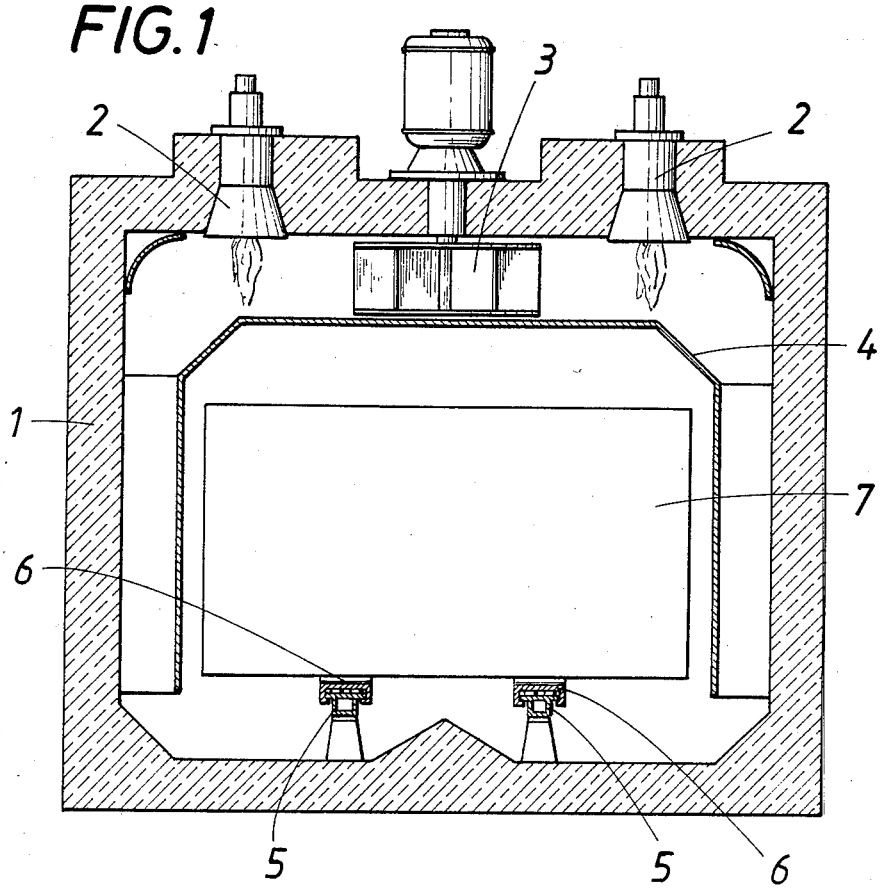

Heating burners 2 are mounted in the roof of a furnace 1. A roof fan 3 and baffles 4 are provided to circulate the furnace gases. Skid rails 5 are mounted on stanchions on the furnace floor and sliding shoes 6, which carry the material to be processed, e.g. slabs 7, can be moved along these rails. As shown in FIG. 2, the rails 5 have recesses 8 in their top surface, in which slip plates 9 are fitted. The slip plates 9 are arranged in two longitudinal rows on each rail 5. Gaps within and between the rows define spaces wherein detritus etc. may accumulate without impairing the slip properties.

Figure 3:
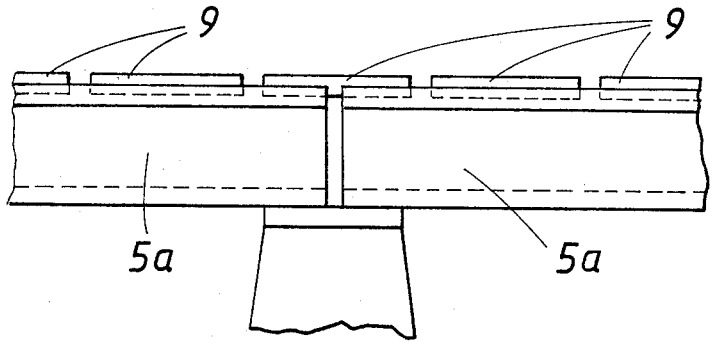
FIG. 3 is a side elevation showing a rail joint.

The rails 5 consist of sections 5*a* (FIG. 3) and each joint between sections is covered by slip plates 9. As FIG. 4 shows, the slip plates 9 in one row may be offset in relation to the slip plates 9*a* in the other row.

The slip plates 9 shown in FIG. 5 have superficial grooves 10 running at an angle to the rail; the grooves 10 in the slip plates 9 in one row are arranged to form a mirror image of the grooves 10 in the slip plates 9 in the other row.

Various forms are possible for the rail cross-section; the essential feature is a flange along both sides which the sliding shoes can hook around. Preferably, the slip plates 9 and 9*a* consist of a special sintered alloy.

What is claimed is:

1. In a pusher-type furnace comprising skid rails for sliding shoes to carry material to be processed through the furnace, and slip elements to reduce the friction between the rails and the sliding shoes, wherein the improvement comprises said slip elements consisting of stationary plates fitted in spaced shallow recesses in the top of said rails and defining gaps therebetween, said slip plates being arranged in two longitudinal rows in the top of each rail and having superficial grooves running at an angle to the rail axis, and said grooves in the plates in one row being arranged as a mirror image of said grooves in the plates in the other row.

2. The improvement set forth in claim 1, wherein said skid rails are comprised of sections, abutting ends of the rail sections forming joints therebetween, and said slip plates cover each joint between the rail sections.

* * * * *